US007168931B2

(12) United States Patent
Ginies

(10) Patent No.: US 7,168,931 B2
(45) Date of Patent: Jan. 30, 2007

(54) GUIDE DEVICE FOR THE MOVABLE SCROLL OF A SCROLL COMPRESSOR

(75) Inventor: Pierre Ginies, Sathony Village (FR)

(73) Assignee: Danfoss Commercial Compressors, Reyrieux (FR)

( * ) Notice: Subject to any disclaimer, the term of this patent is extended or adjusted under 35 U.S.C. 154(b) by 22 days.

(21) Appl. No.: 10/689,985

(22) Filed: Oct. 22, 2003

(65) Prior Publication Data

US 2005/0089431 A1 Apr. 28, 2005

(51) Int. Cl.
*F04C 18/00* (2006.01)
*F03C 2/00* (2006.01)

(52) U.S. Cl. ..... 418/55.3; 418/55.1; 464/102

(58) Field of Classification Search ..... 418/55.1, 418/55.3; 464/102
See application file for complete search history.

(56) References Cited

U.S. PATENT DOCUMENTS 5,538,408 A * 7/1996 Blass et al. ..... 418/55.3
5,562,436 A * 10/1996 Kawahara et al. ..... 418/55.5
6,123,527 A * 9/2000 Kawada et al. ..... 418/55.1
6,666,669 B2 * 12/2003 Süss ..... 418/55.3

FOREIGN PATENT DOCUMENTS

| | | | | |
|---|---|---|---|---|
| EP | 0 478 795 A1 | | 4/1992 | |
| JP | 55051982 A | * | 4/1980 | |
| JP | 02157487 A | * | 6/1990 | ..... 418/55.2 |
| JP | 02161189 A | * | 6/1990 | |
| JP | 05195965 A | * | 8/1993 | |
| JP | A-7-139478 | | 5/1995 | |
| JP | A-2003-161273 | | 6/2003 | |

OTHER PUBLICATIONS

Anonymous "Eccentrically driven counterweight for scroll radial compliance and counterweighting", Research Disclosure, Mason Publications, Hampshire, GB, vol. 445, No. 42, May 2001, XP007128160, ISSN: 0374-4353, The entire document.

* cited by examiner

*Primary Examiner*—Theresa Trieu
(74) *Attorney, Agent, or Firm*—Oliff & Berridge, PLC

(57) ABSTRACT

A device for guiding a movable scroll of a scroll compressor. The device includes a track that guides the movable scroll and supports the radial inertial forces to prevent excessive and potentially harmful contact forces between the fixed scroll and the movable scroll. Hence, the radial inertial forces are supported by the guide track so that the scrolls are not overloaded and there is no risk that the crankshaft will bend.

15 Claims, 6 Drawing Sheets

GUIDE DEVICE FOR THE MOVABLE SCROLL OF A SCROLL COMPRESSOR

BACKGROUND OF THE INVENTION

1. Field of Invention

The invention relates to a device for guiding the movable scroll of a scroll compressor.

2. Description of Related Art

A scroll compressor has an enclosure delimiting a low-pressure chamber and a high-pressure chamber. The low-pressure chamber and the high-pressure chamber are separated by a body that supports a compression device comprised of a fixed scroll and a movable scroll. The movable scroll is entrained orbitally by a shaft and a crankshaft driven by a motor. The fluid travels to the low-pressure chamber through an intake connection, is compressed by the compression device inside chambers delimited between the fixed scroll and the movable scroll, passes into high-pressure chamber, and exits therefrom through a connection.

SUMMARY OF THE INVENTION

As stated above, the movable scroll rotates in an orbital movement, and is subjected to a radial inertial force. Since the fixed scroll and the movable scroll must delimit compression chambers, these chambers must be delimited as precisely as possible. Also, slight contact is provided between the two scrolls or no contact is provided between the two scrolls with a tiny gap that separates the two scrolls sealed with an oil film. When the radial inertial force caused by the movements of the movable scroll increases, the contact force between the two scrolls increases, which could eventually damage these scrolls or necessitate an increased scroll thickness to withstand these constraints.

The elements of which a scroll compressor is composed of are designed for loads corresponding to an electrical frequency of 50 to 60 Hz applied to the motor. The inertial forces can increase in at least two cases. In the first case, if the rotational speed of the compressor increases, the inertial forces increase with the square of the rotational speed ($F=m\times R\times w^2$) where F=force (N), m=mass (kg), R=radius (m), and w=rotational speed (rad/s). In the second case, the compressor has a high capacity with a large movable scroll mass and/or a large orbital radius. A high rotational speed is defined as rotational speeds greater than 3600 rpm, while a high-capacity compressor is defined as a swept volume greater than 41 $m^3/h$.

With these specifications, the thickness of the oil film in the sealing area between the two scrolls is small and the crankshaft can bend so that the functional play between the scrolls can be eliminated. In this case, some of the inertial force is supported by the scrolls, in addition to the loading pressure to which they are already subjected. As a result, the scrolls may break if overloaded. The creation of impact shocks between the fixed scroll and the movable scroll also increases the operating noise.

The invention thus controls radial inertial forces applied to the movable scroll, particularly in the case of high-capacity scroll compressors in which the fixed and movable scrolls have high masses, and/or in the case of scroll compressors in which the rotational speed of the movable scroll is variable.

According to the invention, the invention thus provides a device for guiding a movable scroll of a scroll compressor. The device includes a track that guides the movable scroll and supports the radial inertial forces to prevent excessive and potentially harmful contact forces between the fixed scroll and the movable scroll. Hence, the radial inertial forces are supported by the guide track so that the scrolls are not overloaded and there is no risk that the crankshaft will bend.

According to an exemplary aspect of the invention, the guide track is shaped such that the movable scroll or a part integral therewith is in contact with the track regardless of a rotational speed and the radial inertial forces of the movable scroll. In such a case, guidance is provided regardless of the rotational speed of the movable scroll, and regardless of the inertial forces.

According to another exemplary aspect, the guide track is shaped such that the movable scroll or a part integral therewith is in contact with the track only when the radial inertial forces exceed a preset value. In practice, in this case, when the compressor is rotating at a low speed, and the radial inertial forces are low, the movable scroll or a part integral therewith is not in contact with the guide track. Only when the inertial forces increase does the movable scroll or a part integral with the movable scroll rest on the guide track so that the track supports the inertial forces, in order to prevent excessive bending of the crankshaft and to prevent overly high stresses between the scrolls.

In practice, the guide track can be disposed on the compressor body, being attached thereto or provided therein, can be arranged on the fixed scroll, and in the latter case extend over part of the height of the fixed scroll, or can be provided on the fixed and movable scrolls and they can be obtained by matching the shapes of these scrolls during the orbital movement.

The guide track can be continuous or discontinuous. In one embodiment, the guide track can be circular, but it may also have other shapes. If the guide track is circular, its radius is equal to the radius of the movable scroll plus the radius of orbital movement. The guide track can be of another shape, for example, oval.

According to another exemplary aspect, the guide track also provides orbital guidance of the movable spiral. According to another exemplary aspect, this device equips a compressor in which the drive shaft of the crankshaft has a flat part that rests against a flat part of the bearing driving the movable scroll. According to another exemplary aspect, this device equips a compressor in which the drive shaft of the crankshaft is equipped with a cam cooperating with a circular ring belonging to the drive hub of the movable scroll. As stated above, this device is particularly suited as equipment for variable-speed and/or high-rotational-speed scroll compressors, or for a high-capacity or a variable-capacity scroll compressor.

BRIEF DESCRIPTION OF THE DRAWINGS

In any event, the invention will be readily understood with the aid of the description below with reference to the attached schematic drawings showing several embodiments of this device as nonlimiting examples, wherein.

DETAILED DESCRIPTION OF PREFERRED EMBODIMENTS

Figure 1:
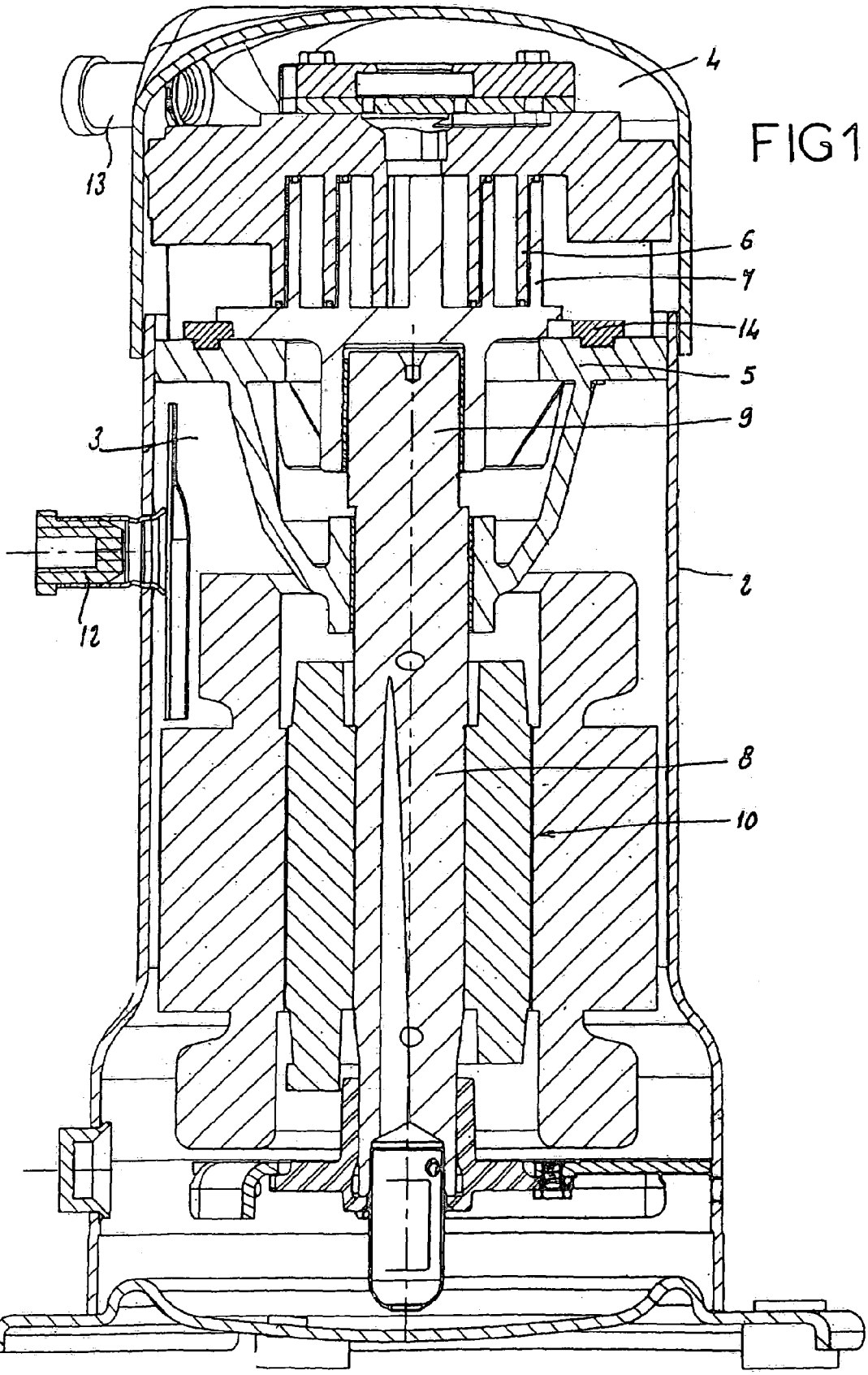
FIG. 1 is a lengthwise section through a scroll compressor equipped with the device according to the invention.

A lengthwise section of a scroll compressor is shown schematically in FIG. 1. This compressor has an enclosure 2 delimiting a low-pressure chamber 3 and a high-pressure chamber 4. The low-pressure chamber 3 and the high-pressure chamber 4 are separated by a body 5 that supports a compression device comprised of a fixed scroll 6 and a movable scroll 7. The movable scroll 7 is entrained orbitally by a shaft 8 and a crankshaft 9 driven by a motor 10. The fluid travels to the low-pressure chamber 3 through an intake connection 12, is compressed by the compression device inside chambers delimited between the fixed scroll 6 and the movable scroll 7, passes into high-pressure chamber 4, and exits therefrom through a connection 13.

Figure 2:
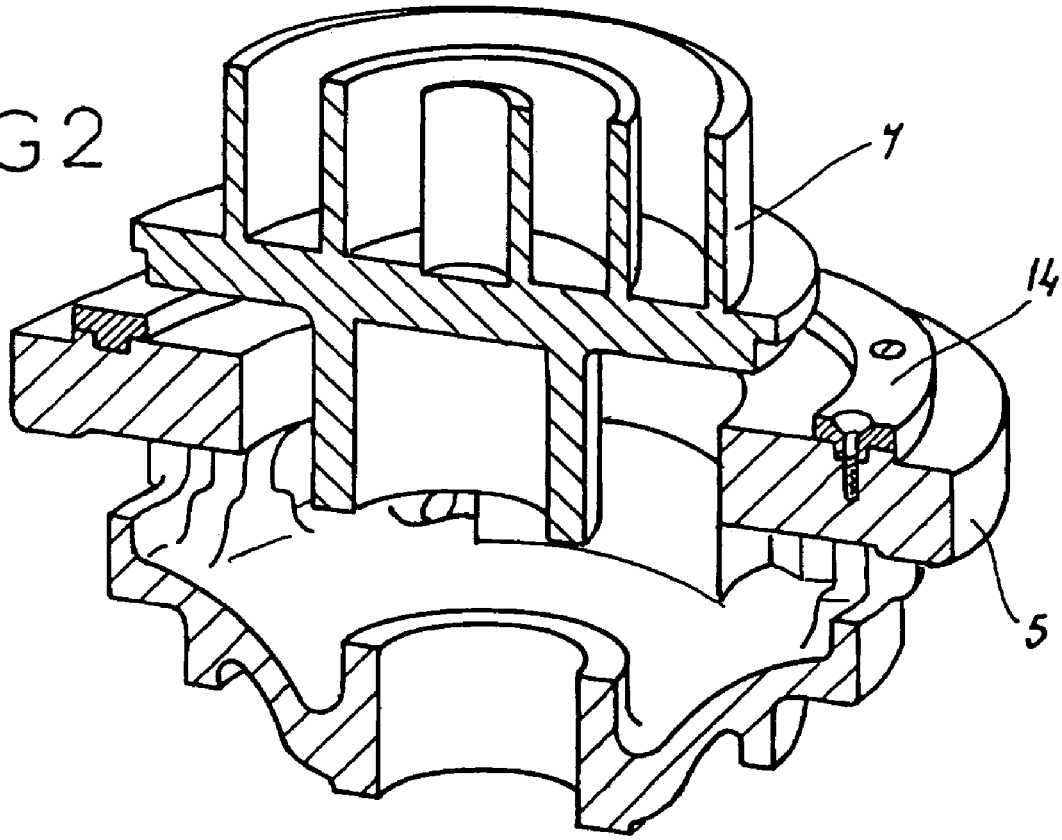
FIG. 2 is an exploded perspective view, partially in cross section, of the device in FIG. 1.
Figure 3:
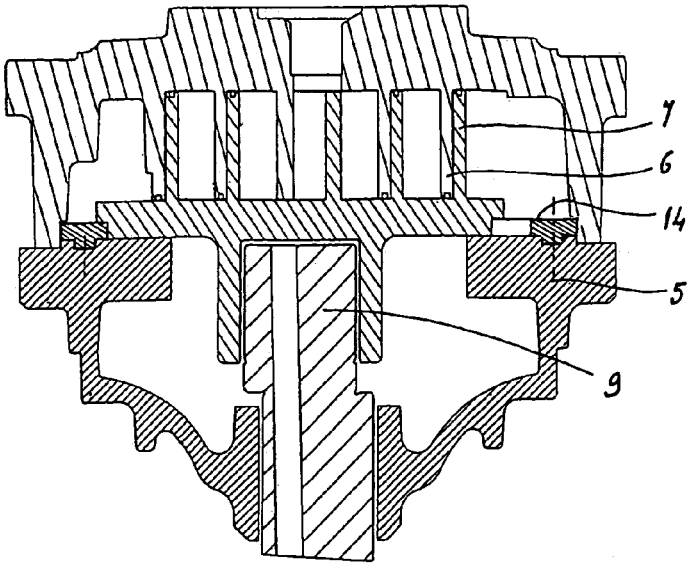
FIG. 3 is a lengthwise sectional view of the device in FIGS. 1 and 2.

In the embodiment shown in FIGS. 1 to 3, the body 5 is equipped with an annular part 14 extending beyond an upper wall of the body. The annular part 14 forms a track that can support the lower side face of the movable scroll 7 during the orbital movement thereof. The movable scroll 7 can rest directly on the annular part 14, or be equipped with a part that is placed on the annular part 14.

Figure 4:
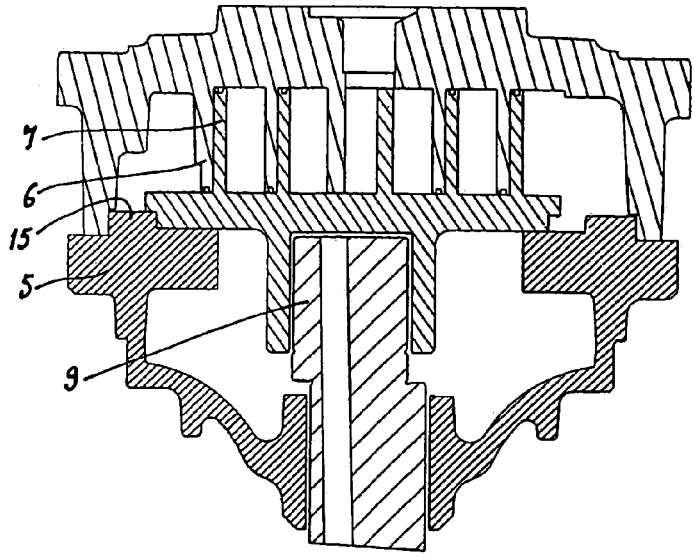
FIGS. 4 and 5 are two views in lengthwise section of two variants of the device in FIGS. 1 and 2.
Figure 5:
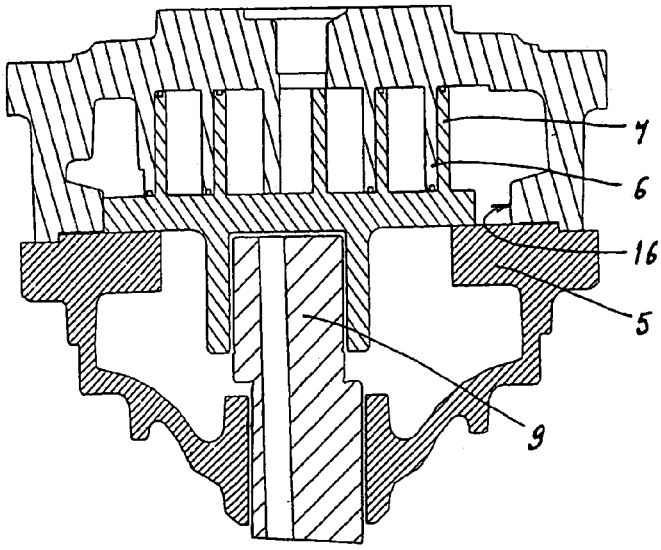

The device shown in FIG. 4 is a variant of the embodiment in FIGS. 1 to 3 in which the annular part 15 is not attached to body 5, but is an integral part of this body 5. In the embodiment shown in FIG. 5, the annular part 16 is arranged in the fixed scroll 6.

Figure 6:
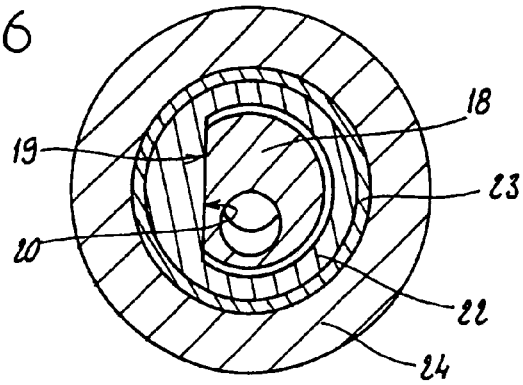
FIGS. 6 to 8 are three cross-sectional views of three methods for driving the movable scroll by the crankshaft.
Figure 7:
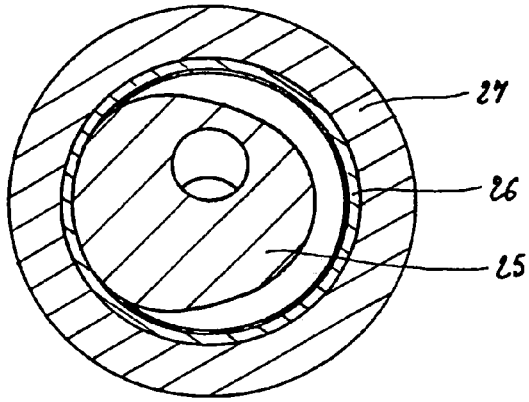
Figure 8:
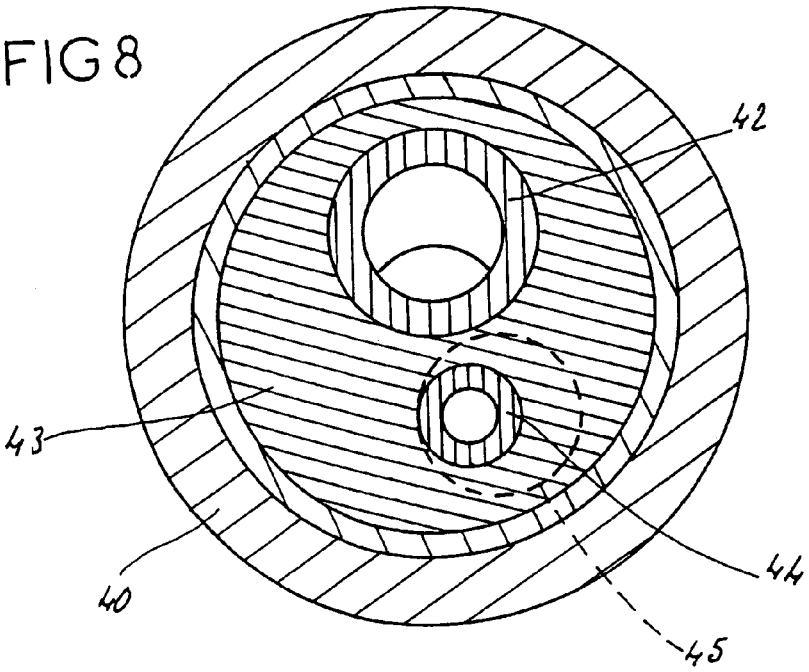

FIG. 6 is a cross section showing a first device driving the movable scroll 7. With this type of drive, the shaft 18 of the crankshaft has a flat part 19 that rests against a flat part 20 of a bearing 22 mounted in a ring 23 disposed in the hub 24 of the movable scroll 7. FIG. 7 shows another method of driving the movable scroll 7 wherein the crankshaft is equipped with a cam 25 disposed inside a circular ring 26 mounted inside the hub 27 of the movable scroll 7. FIG. 8 shows another method of driving the movable scroll 7 whose hub is designated by reference numeral 40. The shaft 42 of the crankshaft transmits the motor torque to a bearing 43 which can pivot about the shaft 42, which modifies the orbital radius and creates radial compliance. A pin 44 integral with the bearing enters a counterbore 45 of the crankshaft and limits the angular travel of the bearing around shaft 42 of the crankshaft.

Figure 9:
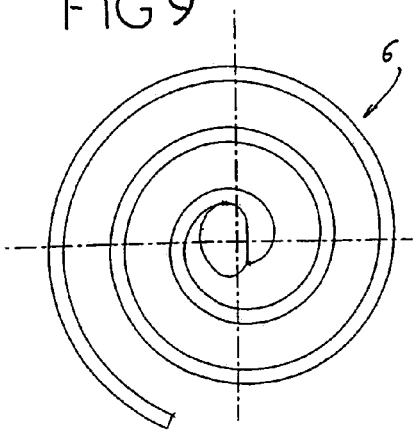
FIGS. 9 and 10 are views of a fixed scroll, and of the same scroll equipped with a guide track, respectively.
Figure 10:
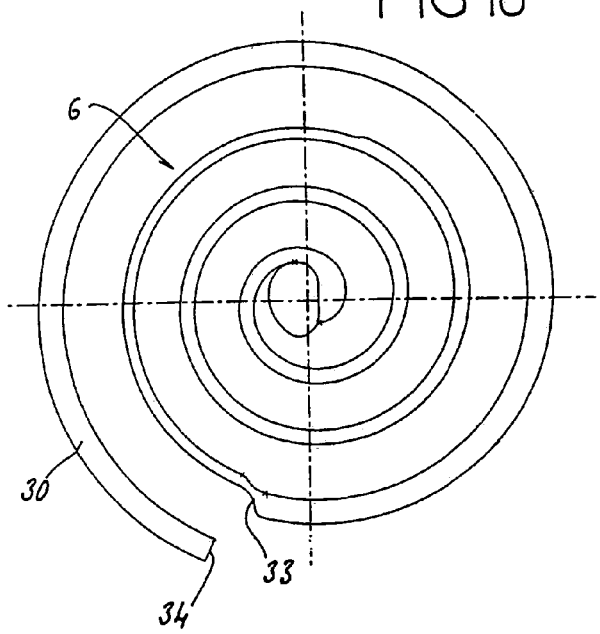
Figure 11:
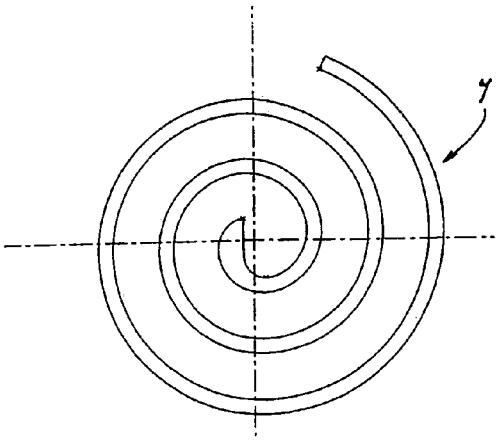
FIGS. 11 and 12 are views of a movable scroll, and the same scroll equipped with a guide track, respectively.
Figure 12:
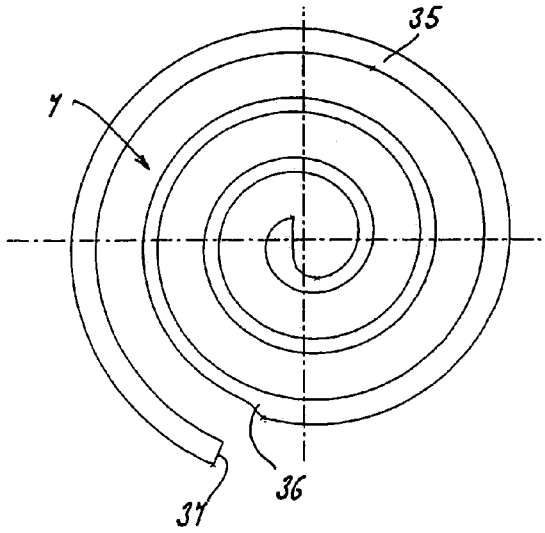
Figure 13:
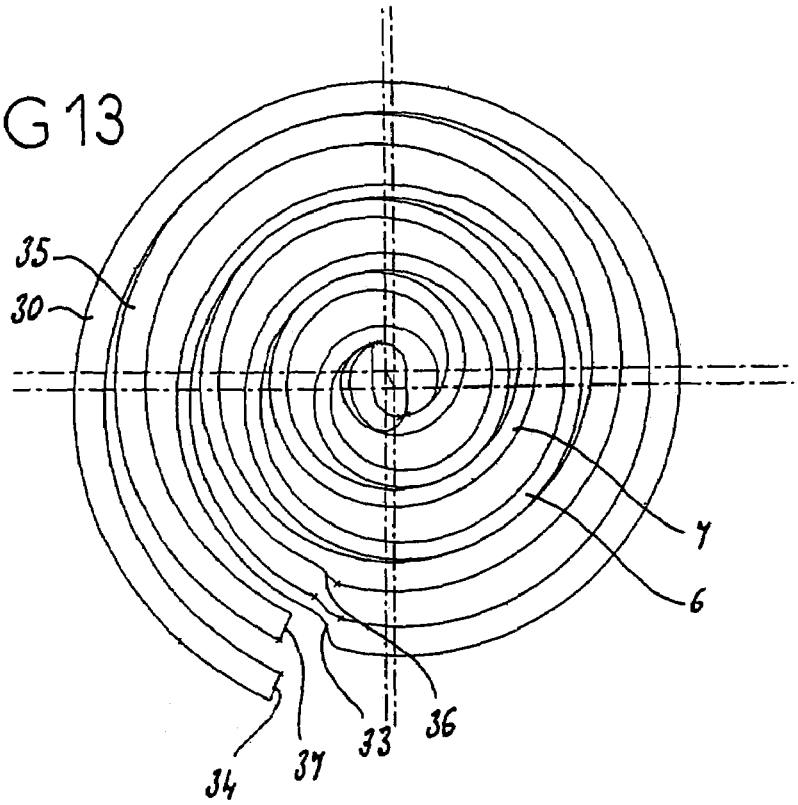
FIGS. 13 and 14 are views in which the scrolls equipped with the track, and shown in FIGS. 9 and 11, are in the utilization position.
Figure 14:
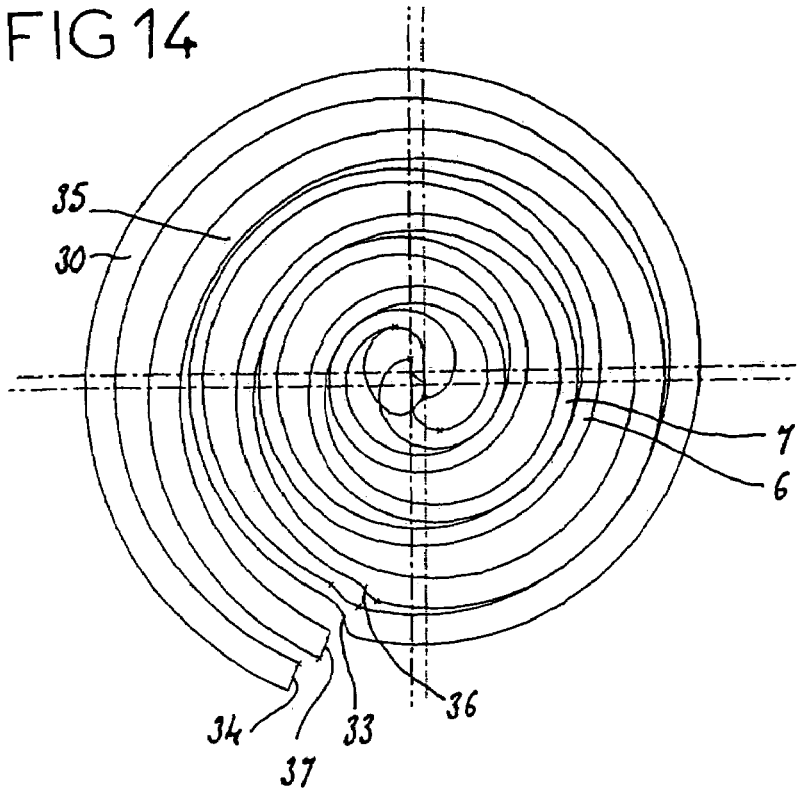

FIGS. 9 and 11 are endwise views of a fixed scroll 6 and a movable scroll 7, respectively. Arc lengths of the scrolls that may be used for compression and form a guide track associated with these two scrolls as shown in FIGS. 10 and 12. The guide track of the fixed scroll is designated by reference numeral 30 and the start and end of the track are designated by reference numerals 33 and 34. The guide track of the movable scroll 7 is designated by reference numeral 35 and the start and end of the track are designated by reference numerals 36 and 37, respectively. FIGS. 13 and 14 show the two scrolls 6 and 7 as well as their guide tracks 30 and 35 in two utilization positions. In this case, tracks 30 and 35 provide the guidance of the movable scroll. It may be noted that these tracks may extend over all or part of the height of the scrolls.

While the invention has been described with reference to preferred embodiments thereof, it is to be understood that the invention is not limited to the disclosed embodiments or constructions. On the contrary, the invention is intended to cover various modifications and equivalent arrangements. In addition, while the various elements of the invention are shown in various combinations and configurations, which are exemplary, other combinations and configurations, including more less or only a single element, are also within the spirit and scope of the invention.

What is claimed is:

1. A device for guiding a movable scroll of a scroll compressor, comprising:

a track that guides the movable scroll and supports radial inertial forces between a fixed scroll and the movable scroll, wherein the movable scroll performs an orbital movement relative to the fixed scroll and the track is shaped such that the movable scroll or a part integral therewith is in contact with the track only when the radial inertial forces exceed a preset value.

2. The device according to claim 1, wherein the track is disposed on a body of the compressor.

3. The device according to claim 1, wherein the track is disposed on the fixed scroll.

4. The device according to claim 3, wherein the track extends over part of a height of the fixed scroll.

5. The device according to claim 1, wherein tracks are arranged on the fixed scroll and the movable scroll and are obtained by conjugated profiles of these scrolls during orbital movement.

6. The device according to claim 1, wherein the track is continuous.

7. The device according to claim 1, wherein the track is discontinuous.

8. The device according to claims 1, wherein the track is circular.

9. The device according to claim 8, wherein a radius of the guide track is equal to a radius of the movable scroll plus a radius of an orbital movement.

10. The device according to claim 1, wherein the track provides orbital guidance of the movable scroll.

11. The device according to claim 1, wherein the device equips a compressor in which a drive shaft of a crankshaft has a flat part that rests against a flat part of a bearing driving the movable scroll.

12. The device according to claim 1, wherein the device equips a compressor in which a drive shaft of a crankshaft is equipped with a cam cooperating with a circular ring belonging to a drive hub of the movable scroll.

13. The device according to claim 1, wherein the device equips a variable-speed and/or high-rotational-speed scroll compressor.

14. The device according to claim 1, wherein the device equips a high-capacity and/or variable-capacity compressor.

15. The device according to claim 1, wherein the track supports the radial inertial forces between the fixed scroll and the movable scroll at all angular positions.

* * * * *